US007542827B2

(12) United States Patent
Gerard et al.

(10) Patent No.: US 7,542,827 B2
(45) Date of Patent: Jun. 2, 2009

(54) SCHEDULING REMOTE STARTING OF VEHICLE

(75) Inventors: Christine M. Gerard, Grayslake, IL (US); Harsha M. Dabholkar, Libertyville, IL (US)

(73) Assignee: Temic Automotive of North America, Inc., Deer Park, IL (US)

( * ) Notice: Subject to any disclaimer, the term of this patent is extended or adjusted under 35 U.S.C. 154(b) by 777 days.

(21) Appl. No.: 10/963,488

(22) Filed: Oct. 12, 2004

(65) Prior Publication Data

US 2006/0080007 A1 Apr. 13, 2006

(51) Int. Cl.
*F02N 11/00* (2006.01)

(52) U.S. Cl. ..... 701/2; 340/425.5

(58) Field of Classification Search ..... 701/2; 307/10.1–10.6, 141, 141.4; 361/195–202; 123/179.1, 179.2, 179.3, 179.4; 340/425.5, 340/825.69, 825.72

See application file for complete search history.

(56) References Cited

U.S. PATENT DOCUMENTS 4,296,334 A * 10/1981 Wong ..... 290/37 R
5,129,376 A * 7/1992 Parmley ..... 123/179.2
5,951,440 A * 9/1999 Reichlinger ..... 477/167
6,028,372 A * 2/2000 West et al. ..... 307/10.6
6,147,418 A 11/2000 Wilson
6,351,703 B1 2/2002 Avery
6,396,388 B1 5/2002 Dong
6,778,065 B1 8/2004 Asakura
6,844,827 B2 * 1/2005 Flick ..... 340/989
7,009,499 B2 * 3/2006 Bernosky et al. ..... 340/426.1

OTHER PUBLICATIONS

Autotoys—Prestige APS996A [2 Way Paging/Remote Start] New Version, http://www.autotoys.com/x/catalog/PRESTIGE_APS996A—2_WAY_PAGING_REMOTE_START_NEW_VERSION_p_57.h..., Jul. 20, 2004, pp. 1-4.

Sciborg 825K 2-Way Pager Security System, Kiramek, http://www.kiramek.com/English/products/sciborg/, Jul. 20, 2004, pp. 1-4.

GPS system specs and technical information, DieselBoss.com. Track Your Rig with DieselBoss™ and InterTrak™, InterTrak™ Vehicle Tracker Specifications, http://www.dieselboss.com/track/specs.htm, Jul. 20, 2004, pp. 1-2.

GPS2000 By Omega R & D, GPS2000 Vehicle Tracking-Theft Notification-Convenience Control, http://www.gps2000online.com/, Dec. 3, 2003, p. 1.

GPS Vehicle Satellite tracking system, vehicle theft recovery, GPS satellite remote control system, fleet tracking, fleet manage . . . , UniTracking VTU: Vehicle & Asset Tracking, http://www.unitracking.com, Dec. 3, 2003, pp. 1-6.

(Continued)

*Primary Examiner*—Dalena Tran

(57) ABSTRACT

A method is described for scheduling the remote starting of an engine of a vehicle. The vehicle includes a remote starting device and a controller coupled to a communication device and to the remote starting device. The remote starting device is responsive to commands from the controller. The method includes a first step of defining a schedule of starting times. A next step includes entering the schedule in the controller. A next step includes controlling an operation of the remote starting device in accordance with the schedule.

10 Claims, 3 Drawing Sheets

OTHER PUBLICATIONS

Directed Electronics,—Auto Security & Convenience Systems—Viper GPS Tracking System, Directed® Electronics, Inc., VIPER® GPS Tracking System, http://www.viper.com/security/viper/gps.asp, Dec. 3, 2003, pp. 1-5.

Networkcar: Stolen Vehicle Recovery, Smart Roadside Assistance, Vehicle Location and Real-time Performance, networkcar, Connect with your inner car.™ Log on., http://www.networkcar.com/networkcar/pub/main, Dec. 3, 2003, pp. 1-2.

* cited by examiner

SCHEDULING REMOTE STARTING OF VEHICLE

FIELD OF THE INVENTION

This invention is generally directed to remote vehicle starting, and in particular to the scheduling of remote vehicle starting.

BACKGROUND OF THE INVENTION

For colder climates, devices have been developed to remotely start a vehicle. The use of such devices allows a user to start their vehicle remotely, from the comfort of a warm environment, such that the vehicle is warmed up and heat is available in the car immediately upon entering the vehicle. In this way, a user is not chilled when sitting in a cold vehicle waiting for it to warm up.

One problem with most existing remote starting devices is their limited range of up to 200 feet. In this case the user must be in proximity to the vehicle before they can start it: Therefore, someone who is returning to their vehicle from work, and is on a train for example, will not be able to start their car until getting off the train. This will not allow the vehicle time to warm up, and defeats the purpose of the remote starter.

Another problem with most existing remote starting devices is that they are installed as an aftermarket unit. Quite often, these aftermarket devices do not work very well due to compatibility issues with the vehicle. In addition, other functions of the vehicle (e.g. normal starting, security features, audio features, etc.) may be compromised by the installation of an aftermarket remote starting unit. Until OEM manufacturers begin providing their own remote starting function, these types of problems will remain.

What is needed is a new technique for remote starting of a vehicle that does not suffer from the aforementioned problems. It would also be of benefit if the technique could be accomplished with little or no additional hardware.

BRIEF DESCRIPTION OF THE DRAWINGS

The features of the present invention, which are believed to be novel, are set forth with particularity in the appended claims. The invention, together with further objects and advantages thereof, may best be understood by making reference to the following description, taken in conjunction with the accompanying drawings, in the several figures of which like reference numerals identify identical elements, wherein:

DETAILED DESCRIPTION OF THE PREFERRED EMBODIMENTS

Figure 1:
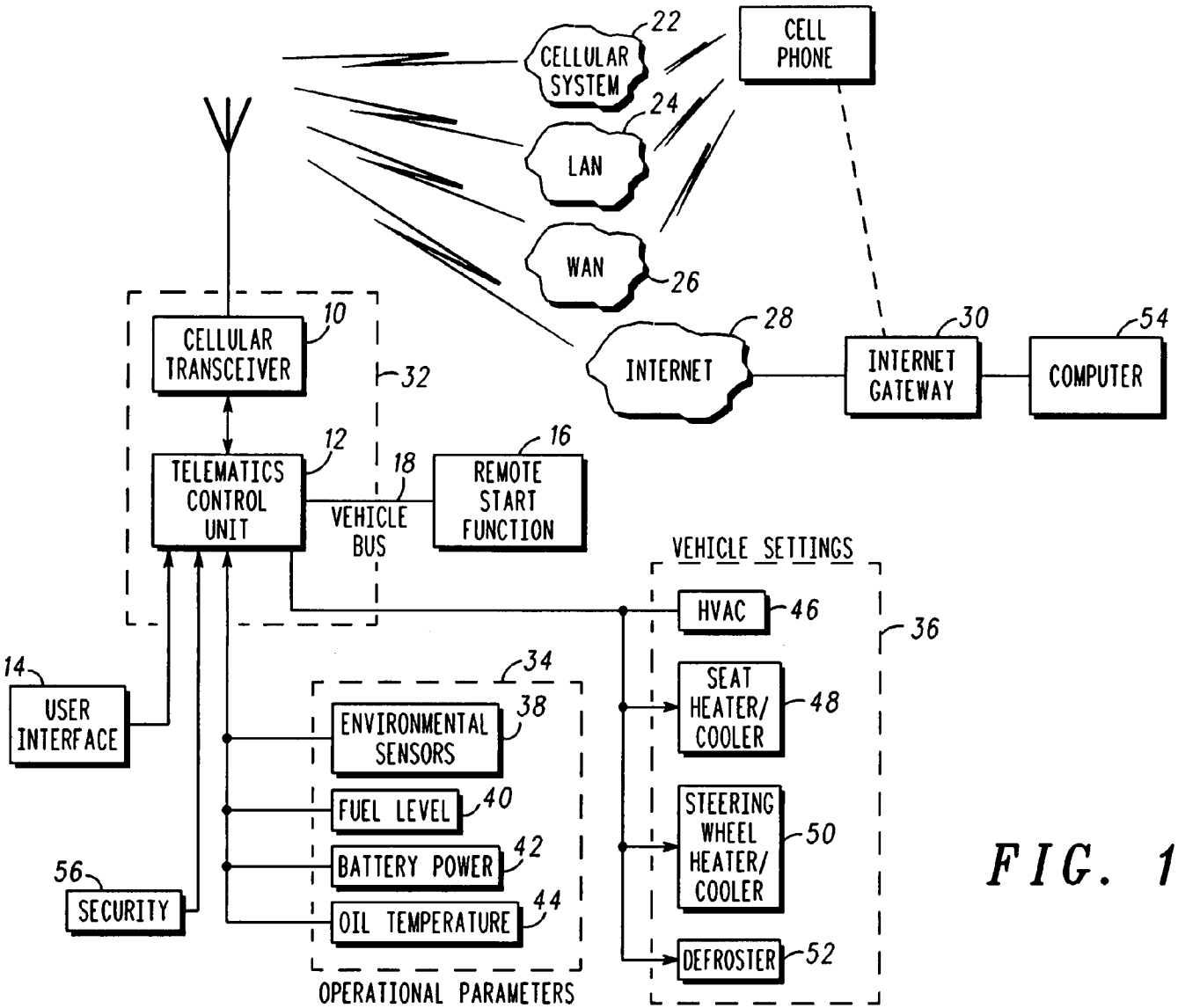
FIG. 1 shows a block diagram of a system overview, in accordance with the present invention.

The present invention provides a control interface to assist in remote starting of a vehicle. In particular, the present invention utilizes an existing radio communication interface to control starting of a vehicle. Specifically, a Telematics control unit (TCU) interfaces with an onboard transceiver to receive a schedule for starting and stopping a vehicle's engine. The TCU controls the vehicle starter circuits through an existing vehicle bus. In addition, the TCU can input vehicle operational and environment parameters to adjust the schedule for optimization. Moreover, the TCU can control many other functions of the vehicle to prepare a comfortable environment for a driver. Further, the improvement provided by the present invention can be combined with a theft alarm to warn a user of a theft of the vehicle during a remote starting mode.

The present invention operates over the cellular network and not through the low range infra-red signaling of traditional remote starters. Since the present invention operates over the cellar network, there is no distance limitation. In addition, the present invention provides the user with the flexibility of setting up a start schedule on a website for when the vehicle will be started. A Telematics Control Unit (TCU) in the vehicle will determine, based on multiple factors, how often and how long the vehicle will be started in order to maintain maximum performance of the vehicle battery, vehicle motor oil and to ensure a comfortable and safe environment for the user before the user enters the vehicle.

On vehicles enabled with network access devices, the start schedule could be accessed through a website, through a menu on the mobile handset, or on a vehicle user interface (heads-up unit). The user would be able to remotely start the vehicle at any single time or enter a schedule for a repeated remote start mode, wherein the vehicle engine would automatically be started and stopped to keep it warm.

Using a single remote start schedule mode, a commuter could use her portable radiotelephone to call her Telematics equipped vehicle to start her vehicle at any time, for example, fifteen minutes before arriving at her destination. The user would then be greeted by a warm vehicle in the winter or a cool vehicle in the summer.

Using a repeated remote start schedule mode, the user would enter her schedule, indicating the time at which she usually starts her vehicle in the morning as well as the time she usually starts her vehicle in the evening. The schedule could also take into account weekdays versus weekends. The Telematics Control Unit (TCU) would then decide how often to start the vehicle and how long to keep the engine running based on such factors as the outside temperature, the windchill factor, the temperature of the motor oil, the strength of the battery, the amount of fuel in the vehicle, or other operational parameters. The goal is to ensure that the battery is kept alive, the motor oil is kept warm, and the interior of the vehicle is warm or cool at the times that the user usually enters the vehicle (as determined by the schedule entered by the user).

Preferably, on a digital cellular communication system, the schedule could be sent to the vehicle as a Short Messaging Service (SMS) message. The vehicle could then return an SMS to the user to inform the user of the status (success/fail) on starting the vehicle.

In addition, if the vehicle were to be moved while in remote start mode, a theft alert could be sent to the user via SMS. On an analog system, a modem call could be placed or DTMF could be used to send the message to the vehicle.

FIG. 1 shows a system for scheduling the remote starting and stopping of an engine of a vehicle having a controller 12 coupled to a communication device 10, in accordance with the present invention. A remote starting and stopping function 16 is provided in the vehicle. The function 16 is responsive to commands from the controller 12. The function can be provided by supplying a mechanical device, such as an aftermarket remote starting device, coupled to the vehicle starting circuit and controller 12. Preferably, the remote starting function 16 is provided with little or no hardware modifications to the vehicle by utilizing a command issued by the controller 12 over the vehicle bus 18 to trigger the ignition. This capability can be provided in vehicles with integrated Telematics systems, for example.

A schedule of a desired starting time or a plurality of starting and stopping times is defined by a user of the vehicle. Preferably, the schedule includes desired settings of vehicle controls 36, that are then included with the schedule. The vehicle controls 36 can be associated with a driver's comfort or safety, and can include operating the defroster 52, turning on a seat warmer or cooler 48, turning on a steering wheel warmer or cooler 50, or operating the heating, ventilation, or air conditioning (HVAC) controls 46. The actual scheduling and vehicle control setting can be done manually on a user display 14 of the vehicle. However, in practice, a remote programming device, such as a user's cellular radiotelephone 20 could be used with a menu features to program the schedule and vehicle settings and transmit these to the vehicle's Telematics control unit for execution. Alternatively, the remote programming device could be a computer 54 with a wireless IP address for Internet access, such that the schedule and vehicle settings could be maintained on an Internet gateway network 30, wherein the schedule and vehicle settings could be directly transmitted over the Internet 28 to a Telematics-equipped vehicle 32 with an optional wireless IP address for Internet access. Optionally, the user's cellular radiotelephone 20 could transmit the schedule over the Internet 28 to the vehicle 32, if the cellular radiotelephone has Internet capabilities.

In either case, the schedule and vehicle settings can be transmitted from a remote device (20, 54) over a communication system (22, 24, 26, 28) to the communication device 10 of the vehicle 32. The communication system can be a local area network 24, wide area network 26, cellular communication network 22, or Internet 28. For example, the schedule or starting time can be transmitted using the Short Messaging System available with digital cellular networks 22. The schedule can be a single desired start time or a plurality of preprogrammed start and stop times. Optionally, the controller 12 of the vehicle 32 can take a single start time schedule or a plurality of start and stop times and further modify the schedule with additional multiple start and stop times, as needed, and as will be explained below.

The schedule can include a calendar-based schedule. For example, a schedule can be made up wherein the vehicle is remote started only on weekdays at 6am. In addition, the schedule can include an event-based schedule. For example, a schedule can be made up wherein the vehicle is remote started only on weekdays at 6am, if the temperature is below freezing. The controller 12 enters the schedule and desired vehicle settings in a memory (not shown).

In a preferred embodiment, the controller 12 determines at least one operation parameter 34 associated with the vehicle, and relating to an environment of the vehicle (e.g. outside temperature). These operational parameters 34 can include a temperature of the motor oil of the vehicle 44, a strength or power level of the vehicle battery 42, the amount of fuel in the vehicle 40, etc. In addition, some vehicles have environmental sensors 38 built in that can be used. For example, along with temperature and humidity sensors, windshield sensors can be used to detect rain or ice. In this case, the defroster 52 vehicle setting can be turned on while the engine is warming up. Optionally, the communication device 10 can download weather information from an Internet website in lieu of sensors.

Upon inputting one or more operational parameters, the controller 12 can adjust the schedule in accordance with the operational parameter. For example, if a single start time is scheduled, the controller can provide auxiliary start and stop times in the schedule dynamically in accordance with the operational parameter. In particular, a control algorithm can be used that periodically inputs the operational parameters 34 to the controller 12, wherein the controller can dynamical determine the auxiliary start and stop times for the schedule. For example, the controller can know or learn how long it takes the vehicle to warm up given a particular outside temperature.

Alternatively, the operational parameters can be compared to predetermined setpoints, wherein if none of the parameters exceed the setpoint trigger (e.g. the temperature is already above freezing), then auxiliary start and stop times need not be provided.

In any event, the controller 12 will control the remote starting and stopping function 16 and vehicle settings 36 in accordance with the original or adjusted schedule.

In a preferred embodiment, the controller 12 sends a message from the communication device 10 over the communication system (22,24,26,28) to a user indicating a status of the engine of the vehicle. In other words, a message can be sent to a user indicating whether the engine has started or stopped according to schedule, or indicating that there is a problem and what the problem is, such that the user can take the appropriate actions.

Optionally, the controller 12 can provide a theft alarm coupled to the communication device 10, using existing security features 56 of the vehicle. For example, the controller will be able to detect if the theft alarm is activated during an operational time of the schedule (i.e. when the vehicle is unattended). Upon detection, the controller 12 can send a message with the communication device 10 over the communication system, to a cellular phone 20 of a user for example, indicating the theft of the vehicle.

The present invention also includes a method for scheduling the remote starting (and stopping) of an engine of a vehicle having a controller coupled to a communication device.

A first step 100 includes providing a remote starting and stopping function in the vehicle responsive to commands from the controller. This can be done by supplying a mechanical device, such as an aftermarket remote starting device coupled to the vehicle starting circuit and controller. Preferably, this is provided without little or no hardware modifications to the vehicle by using a command issued by the controller over the vehicle bus to trigger the ignition. This capability can be provided in vehicles with integrated Telematics systems, for example.

A next step 102 includes defining a schedule of a desired starting time or a plurality of starting and stopping times. Preferably, this defining step also includes defining settings of vehicle controls that are then associated with the schedule. The vehicle controls of interest are associated with a driver's comfort or safety, and can include operating the defroster, turning on a seat warmer or cooler, turning on a steering wheel warmer or cooler, or operating the heating, ventilation, or air conditioning (HVAC) system of the vehicle. The actual scheduling and vehicle control setting can be entered manually on a user display of the vehicle. However, in practice, a remote programming device, such as a user's cellular radiotelephone could be used with menu features to program the schedule and vehicle settings and transmit 104 these over the cellular communication network or an Internet connection to the vehicle's Telematics control unit for execution. Alternatively, the remote programming device could be a computer with a wireless IP address for Internet access, such that the schedule and vehicle settings could be maintained on an Internet gateway network, wherein the schedule and vehicle settings could be directly transmitted to a Telematics-equipped vehicle with an optional wireless IP address for Internet access.

In either case, the schedule and vehicle settings can be transmitted 104 from a remote device over a communication system to the communication device of the vehicle. The communication system can be a local area network, wide area network, cellular communication network, or Internet connection. For example, the schedule or starting time can be transmitted using the Short Messaging System available with digital cellular networks. The schedule can be a single desired start time or a plurality of preprogrammed start and stop times. Optionally, the controller of the vehicle can take a single start time schedule or a plurality of start and stop times and further modify the schedule with additional multiple start and stop times, as needed, and as will be explained below.

The schedule can include a calendar-based schedule. For example, a schedule can be made up wherein the vehicle is remote started only on weekdays at 6am. In addition, the schedule can include an event-based schedule. For example, a schedule can be made up wherein the vehicle is remote started on a certain day, or only on weekdays at 6am if the temperature is below freezing, for example.

A next step 106 includes entering the schedule and vehicle settings in the controller.

A next step 108 includes determining at least one operation parameter associated with the vehicle, and relating to an environment of the vehicle (e.g. outside temperature). These operational parameters can include a temperature of the motor oil of the vehicle, a strength or power level of the vehicle battery, the amount of fuel in the vehicle, etc. This information can be obtained from the vehicle bus or from dedicated sensors. In addition, some vehicles have environmental sensors built in that can be used. For example, along with temperature and humidity sensors, windshield sensors can be used to detect rain or ice. In this case, instructions can be provided to turn the defroster on while the engine is warming up. Optionally, the communication device can download weather information from an Internet website in lieu of sensors.

A next step 110 includes adjusting the schedule in accordance with the at least one operational parameter. In other words, the controller collects data from vehicle sensors or other means to determine the necessary frequency and duration of ignition cycles. For example, if a single start time is scheduled, the controller can providing 112 auxiliary start and stop times in the schedule dynamically in accordance with the at least one operational parameter. In particular, a control algorithm can be used that periodically inputs the operational parameters to dynamically determine the auxiliary start and stop times for the schedule.

EXAMPLE

The operational parameters in the above method can include parameters concerning one or more of the vehicle's oil, battery, fuel level, build-up on the windshield, and temperature. For example, the parameters associated with the vehicle's oil can include oil temperature, minimum oil temperature, oil heat rate, and oil cool rate. In addition, the parameters associated with the vehicle's battery can include level of battery charge, minimum battery level, good battery level, battery charge rate, and battery discharge rate. Further, the parameters associated with the vehicle's fuel level can include fuel burn rate, and minimum fuel level. The parameter associated within any build up (e.g. ice, snow, or dirt) on the windshield is compared against a threshold determined by a windshield sensor. The parameters associated with the temperature include high and low limit of an acceptable temperature comfort range, as defined by a user preference. All measurements against these parameters are determined by specific vehicle sensors tailored for that particular measurement, as are known in the art. It should be noted that the battery charge rate, battery discharge rate, oil cool rate, and oil heat rate are calculated based on the rate of change (either standard or calculated) given the current temperature and windchill of the vehicle environment.

Figure 2:
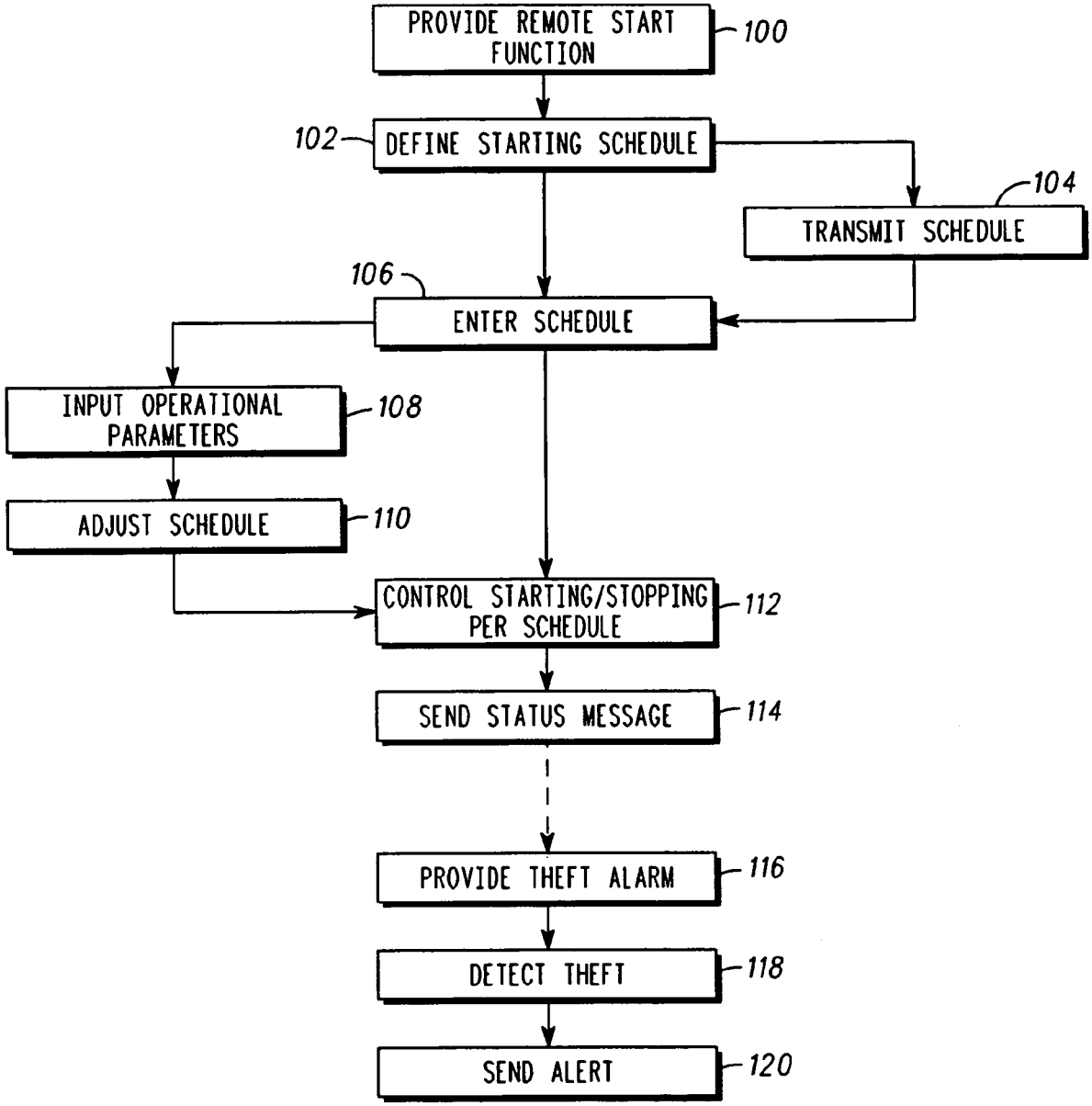
FIG. 2 is a flow chart of a method, in accordance with the present invention.
Figure 3:
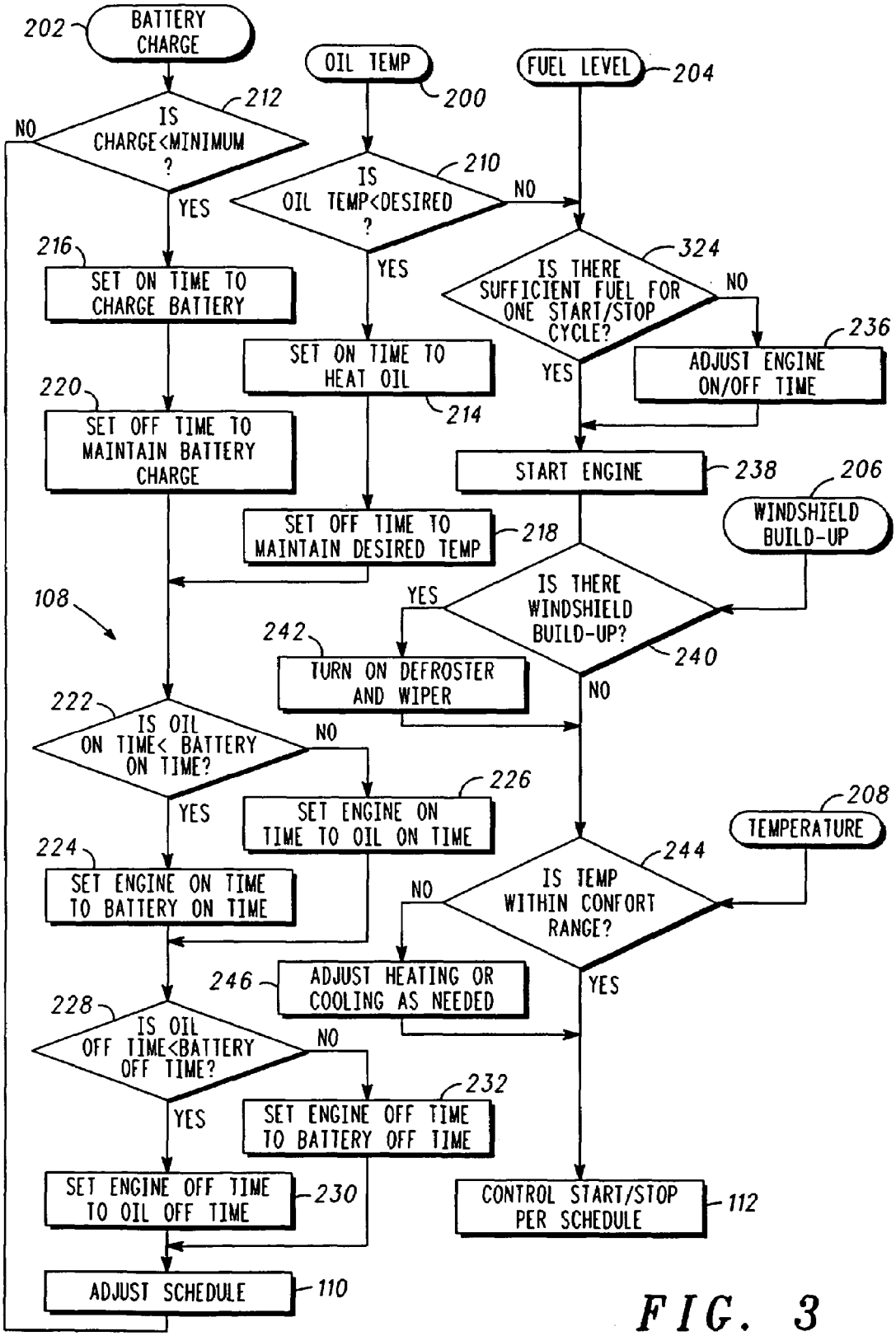
FIG. 3 shows a flow chart of a control algorithm used in accordance with the system and method of the present invention.

Referring to FIG. 3, a flow chart is shown expanding several steps (of FIG. 2) demonstrating the use of measurements and the above parameters for use in a control algorithm. In particular, the schedule input to the vehicle can include standard scheduled engine start and stop times (i.e. periodic amounts of time to have the engine running and have the engine stopped) and adjust the start and stop times, as detailed below.

Regarding the oil temperature 200, if the current oil temperature is less than a desired oil temperature 210 than the scheduled start 214 and stop 218 times of the engine can be changed to maintain the oil temperature above the desired level. Otherwise, the standard start/stop schedule can be used. In particular, the engine on time to heat the oil is set to the desired oil temp minus the current oil temperature, which is then divided by the oil heat rate. Similarly, the engine off time that will keep the oil heated above the desired temperature is set to the desired oil temp minus the minimum oil temperature, which is then divided by the oil cool rate.

Regarding the battery charge level 202, if the current battery level is less than a minimum battery level 212 than the scheduled start 216 and stop 220 times of the engine can be changed to maintain the battery level. Otherwise, the standard start/stop schedule can be used. In particular, the engine on time to charge the battery is set to a known good battery level minus the current battery level, which is then divided by the battery charge rate. Similarly, the engine off time that will keep the battery charged is set to the known good battery level divided by the battery discharge rate.

If the engine on time 222 specified by the oil parameters 214 is less than the engine on time specified by the battery parameters 216, then the engine on time is set to the engine oil time specified by the battery parameters 224. Otherwise, the engine on time is set to the engine on time specified by the oil parameters 226. Correspondingly, if the engine off time 228 specified by the oil parameters 218 is less than the engine off time specified by the battery parameters 220, then the engine off time is set to the engine off time specified by the oil parameters 230. Otherwise, the engine off time is set to the engine off time specified by the battery parameters 232.

At this point, the standard schedule can be adjusted 110 to accommodate the oil and/or battery parameters as discussed above. However, before the engine can be started, it must be determined whether there is sufficient fuel 204 to accommodate at least one starting cycle 234. If the current fuel level is greater than the minimum fuel level plus the product of the scheduled engine on time multiplied by the fuel burn rate, then there is sufficient fuel :for at least one on/off cycle. Afterwards, the algorithm can check if there is enough time for at least one on/off cycle, and check if the upcoming cycle is the last cycle in the schedule. To check if there is enough time for a full cycle, the algorithm checks if the current time plus twice the engine on time plus the engine off time is less than the time when the user will be arriving to drive the vehicle. If this is the case (i.e. a full cycle time is available), then the algorithm can move on to start the engine 238.

Otherwise, if there is not enough time for a lull cycle the engine on/off times can be adjusted 236. For example, if the difference between the time when the user will arrive and the engine on time, minus the sum of the current time and engine on time, is greater than the time when the user will arrive, then there is not enough time for a full cycle, and the current start/stop interval can be skipped and the engine on/off times can be adjusted 236, wherein the engine off time is set to the difference between the time the user will arrive minus the current time, minus the engine on time. Otherwise, the algorithm is on the last on/off cycle.

At this point the engine can be started 238 as part of an on/off cycle. If a sensor detects 240 any windshield build-up, the defroster and/or windshield wiper can be turned on 242. If there are different sensor to detect fog on the inside of the windshield or build-up on the outside of the windshield, then different actions can be taken, For example, if there is fog on the inside of the windshield, the defroster(s) can be turned on when the engine is on. If there is snow or ice build-up on the outside of the windshield, then the defroster(s) and/or wipers can be turned on when the engine is on. Further, it can be of benefit if the wipers are only turned on for a few wipe cycles and/or at different engine on times, such as every other engine on cycle, for example. In particular, the vipers could be turned on for 'x' wipe cycles during every engine on cycle divided by 'y', where x and y are integers that are either predetermined or determined depending on other input parameters such as temperature, windchill, etc.

In addition, the algorithm can check for temperature conditions 244, wherein if the temperature is outside of a user's preferred temperature comfort range, then the vehicle interior can be heated or cooled 246 to suit the user. For example, if the current interior temp is less than a user's desired range of temperatures on the low side, then heating is needed and the vehicle can be instructed to turn on the heating vent, fan, seat warmers, steering wheel warmers, etc., as equipped and according to user preferences. Conversely, if the current interior temp is more than a user's desired range of temperatures on the high side, then cooling is needed and the vehicle can be instructed to turn on the air conditioning, blower fan, seat coolers, steering wheel coolers, etc., as equipped and according to user preferences. Otherwise, if the temperature is within the user's temperature comfort range, no HVAC actions are taken.

Alternatively to the above algorithm, the operational parameters can be compared to predetermined setpoints, wherein if none of the parameters exceed the setpoint trigger (e.g. the temperature is already above freezing), then adjusted start and stop times need not be provided.

A next step 112 includes controlling the remote starting and stopping function and vehicle settings in accordance with the original or adjusted schedule until the user arrives and enters the vehicle at the scheduled time.

A next step 114 includes sending a message from the communication device over the communication system to a user indicating a status of the engine of the vehicle.

Optionally, the method can include a theft alert in response to existing security features or added theft alarm. In particular, substeps can be added to the method including: providing 116 a theft alarm coupled to the communication device of the vehicle, detecting 118 if the theft alarm is activated during an operational time of the schedule, and sending 120 a message indicating the theft from the vehicle from the communication device over the communication system.

While the present invention has been particularly shown and described with reference to particular embodiments thereof, it will be understood by those skilled in the art that various changes may be made and equivalents substituted for elements thereof without departing from the broad scope of the invention. In addition, many modifications may be made to adapt a particular situation or material to the teachings of the invention without departing from the essential scope thereof. Therefore, it is intended that the invention not be limited to the particular embodiments disclosed herein, but that the invention will include all embodiments falling within the scope of the appended claims.

What is claimed is:

1. A method for scheduling remote starting and stopping of an engine of a vehicle having a controller coupled to a communication device, the method comprising the steps of:

providing remote starting and stopping functions in the vehicle responsive to commands from the controller;

defining a schedule of at least one start time of the engine at a remote device;

transmitting the schedule from the remote device over a communication system to the communication device of the vehicle;

entering the schedule into the controller;

determining at least one operational parameter associated with the vehicle;

the controller in the vehicle dynamically determining auxiliary start and stop times of the engine in accordance with the at least one operational parameter and modifying the schedule entered into the controller with the auxiliary start and stop times of the engine; and the controller controlling an operation of the remote starting and stopping functions in accordance with the schedule.

2. The method of claim 1, wherein the operational parameter includes at least one of a temperature of the motor oil of the engine, a strength of the vehicle battery, and an amount of fuel in the vehicle.

3. The method of claim 2, wherein the message is a Short Messaging Service (SMS) message.

4. The method of claim 1, further comprising the steps of:

providing a theft alarm coupled to the communication device of the vehicle;

detecting if the theft alarm is activated during an operational time of the schedule; and sending a message, from the vehicle communication device over the communication system, indicating the theft.

5. The method of claim 1, wherein the defining step includes defining settings of vehicle controls associated with the schedule, the transmitting step includes transmitting the settings along with the schedule, the entering step includes entering the settings, and the controlling step includes setting the vehicle controls in accordance with the transmitted vehicle control settings.

6. The method of claim 1, wherein the schedule includes a calendar-based schedule.

7. The method of claim 1, wherein the schedule includes an event-based schedule.

8. The method of claim 1, wherein the schedule includes a plurality of start and stop times of the engine.

9. The method of claim 1, wherein the step of transmitting the schedule includes a user transmitting the schedule in a Short Messaging Service (SMS) message.

10. The method of claim 1, further comprising the step of:

sending a message, from the vehicle communication device over the communication system, to a user indicating a status of the engine of the vehicle.

* * * * *